US006996881B2

(12) United States Patent
Kjellberg

(10) Patent No.: US 6,996,881 B2
(45) Date of Patent: Feb. 14, 2006

(54) METHOD AND PLANT FOR AUTOMATIC WASHING AND/OR IRONING OF SUBSTANTIALLY FLAT OBJECTS, AND PLANT FOR CARRYING OUT THE METHOD

(75) Inventor: Bent Ivan Kjellberg, Rønne (DK)

(73) Assignee: Katva Investments Limited, (GI)

( * ) Notice: Subject to any disclaimer, the term of this patent is extended or adjusted under 35 U.S.C. 154(b) by 110 days.

(21) Appl. No.: 10/380,012

(22) PCT Filed: Sep. 11, 2001

(86) PCT No.: PCT/DK01/00589

§ 371 (c)(1),
(2), (4) Date: Jun. 27, 2003

(87) PCT Pub. No.: WO02/22938

PCT Pub. Date: Mar. 21, 2002

(65) Prior Publication Data

US 2004/0025311 A1 Feb. 12, 2004

(51) Int. Cl.
*D06C 3/00* (2006.01)

(52) U.S. Cl. ..... 26/51; 26/52; 38/143

(58) Field of Classification Search ..... 26/51, 26/52, 71, 72, 87, 88, 93, 96, 99, 53, 106; 38/44, 45, 46, 55, 102.91, 143, 102, 102.1, 38/102.3, 144; 112/103, 118, 119; 414/13; 68/13 R, 28, 210, 211, 212; 134/15, 32, 134/64 R, 82, 122 R, 137; 28/165, 167; 8/147, 148, 151, 149.1–149.3; 34/380, 381, 34/427, 444, 459, 60, 90, 611, 618–621, 623, 34/627, 658

See application file for complete search history.

(56) References Cited

U.S. PATENT DOCUMENTS 190,444 A * 5/1877 O'Thayne ..... 38/45

(Continued)

FOREIGN PATENT DOCUMENTS

EP 0 620 310 A 10/1994

(Continued)

*Primary Examiner*—Amy B. Vanatta
(74) *Attorney, Agent, or Firm*—William J. Sapone; Coleman Sudol Sapone P.C.

(57) ABSTRACT

Method and plant for processing in the form of washing and/or ironing of substantially flat items (4), such as textiles and the like, which individually can be fed continuously and successively into a processing plant. The processing plant contains fixed as well as movable, tubular parts (12, 13, 14, 15), where the process or the processes take place in a forwardly-progressing movement by means of a holding arrangement (6) with a holding device (7) for the securing and stretching-out of one or more items (4), the holding arrangement (6) securing the item (4) or the items (4) from the feeding-in part (1) in the process, through washing and/or ironing parts until the processes are concluded. A plant for the execution of the method was the fixed and the movable parts which form part of the processing part of the plant consisting of a number of tubular elements (12, 13, 14, 15) which are disposed in a substantially horizontal manner and transversely to the processing direction. The movable element or elements (13, 15), preferably placed between fixed elements, are displaceable in a more or less vertical direction. A plant for execution of the method has the individual item (4) provided with a provisionally fixed front edge (6) which extends wholly or partly along the front of the item (4) seen in the direction of transport.

20 Claims, 6 Drawing Sheets

Figures 1, 1A:
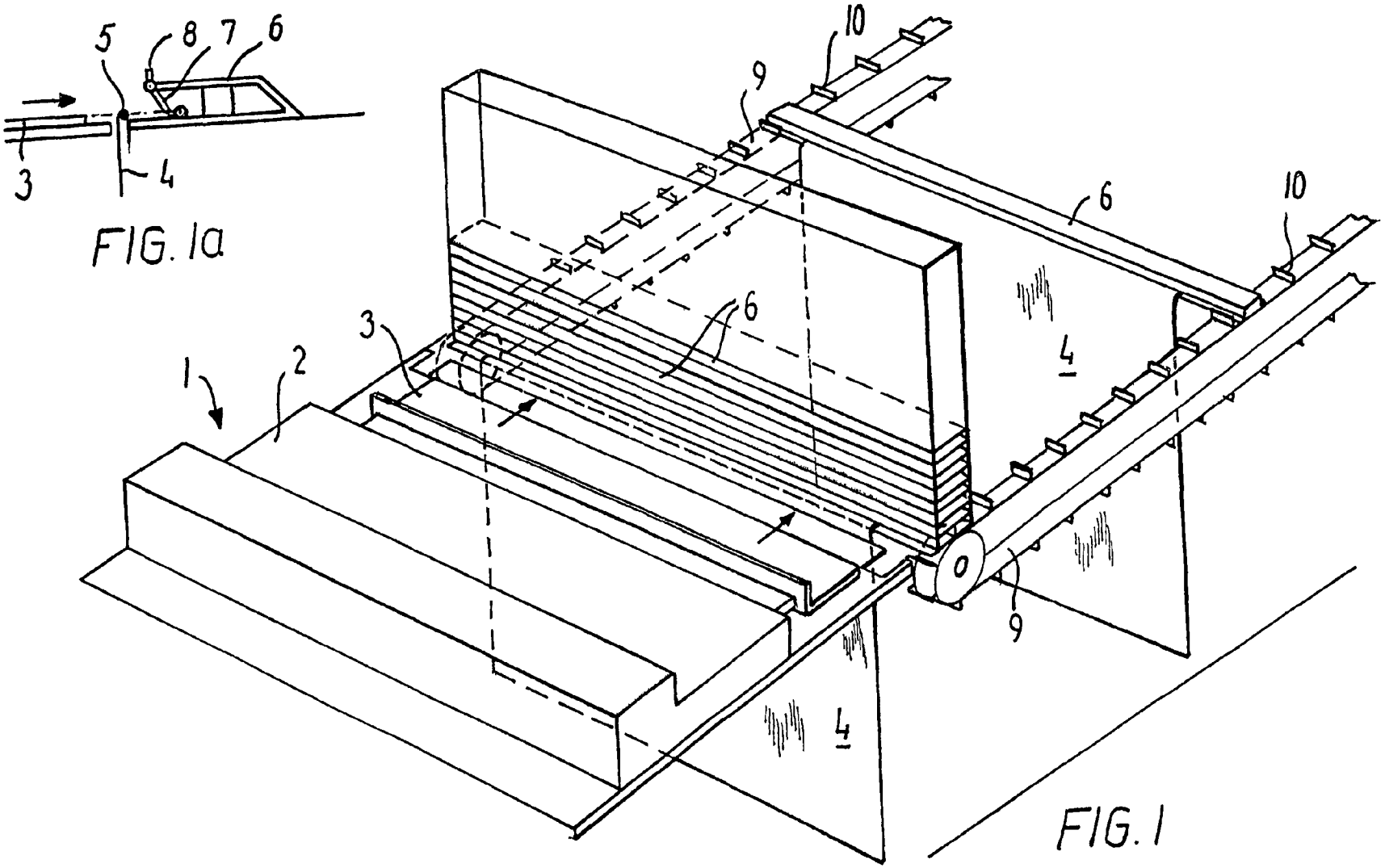

U.S. PATENT DOCUMENTS 1,372,183 A * 3/1921 Metcalf et al. ..... 38/143
1,582,379 A * 4/1926 Campbell ..... 38/46
1,736,686 A * 11/1929 Williams ..... 26/93
1,912,466 A 6/1933 Remington
2,221,987 A * 11/1940 Mees et al. ..... 38/3
3,055,048 A * 9/1962 Koppehele ..... 26/72
3,729,846 A * 5/1973 Weir ..... 38/143
3,771,952 A * 11/1973 Holm ..... 8/149.1
4,053,967 A * 10/1977 Mair ..... 26/98
4,143,476 A * 3/1979 Holmes et al. ..... 38/7
4,299,521 A * 11/1981 Jensen ..... 414/13
4,760,626 A 8/1988 Lönner et al.
4,799,368 A 1/1989 Tissari
5,152,235 A * 10/1992 Goto et al. ..... 112/63
5,159,733 A * 11/1992 Fleming et al. ..... 26/93
5,172,502 A * 12/1992 Kober ..... 38/7
5,416,992 A * 5/1995 Ueda et al. ..... 38/143
5,430,915 A * 7/1995 Ueda et al. ..... 26/51
5,440,810 A * 8/1995 Borucki et al. ..... 38/143
5,611,159 A * 3/1997 Jensen ..... 38/143
5,815,963 A * 10/1998 Rauch et al. ..... 38/143

FOREIGN PATENT DOCUMENTS

EP 0 751 251 A 1/1997
GB 2 226 574 A 7/1990

* cited by examiner

METHOD AND PLANT FOR AUTOMATIC WASHING AND/OR IRONING OF SUBSTANTIALLY FLAT OBJECTS, AND PLANT FOR CARRYING OUT THE METHOD

The invention relates to a method for the processing in the form of washing and/or ironing of substantially flat objects such as textiles and the like, which by a feeding-in apparatus can be introduced automatically and fed successively and continuously into a processing plant, said processing plant containing both fixed as well as movable parts.

The invention also relates to a plant for the execution of the method according to the invention.

The known technique

Large washing and ironing plants are known for industrial laundering of items for hospitals or similar large institutions. The work of placing the items in the washing and/or ironing plants, either at the start or at an intermediate change in the process, e.g. from washing process to ironing process, is a particularly troublesome operation for the personnel who carry it out, the reason being that the items are heavy to handle when they are still damp. The normal procedure in the handling of the items, which can be sheets, duvet covers, blankets and the like, is that the individual items are taken up from a large movable container in which the items are often tangled to- gether with one another, and hung up in a so-called self-feeder. The self-feeder consists of a pair of clamps which can be moved away from each other on a horizontal slide rod. When the corner parts of the items are clamped fast in the clamps arranged for this purpose, the clamps are forced away from each other so that the items are stretched out when being fed in to the relevant plant.

This form of feeding-in is not ideal, especially because the personnel who hang the items up in the self-feeder are burdened by having to bend down to collect the items, and thereafter hold them up with outstretched arms in order to secure the items in the gripping arrangement in the self-feeder, which must hold the individual items stretched out so that these can be processed over the whole of their surface and without the items getting wrinkled.

From EP 0 620 310 A1 and EP 0 751 251 A1 there are known automatic self-feeders which grip the items and feed them into the subsequent process in a processing sequence. These self-feeders grip the items and feed them into an apparatus, after which the self-feeders or the gripping arrangements release the items which are then fed through the apparatus by other means. When the item comes out of the relevant apparatus after the conclusion of the processing, they are gripped by other arrangements which feed them further to the next processing station or apparatus.

By these methods with many different gripping arrangements which grip and release the items many times during their passage through a processing sequence, there is great probability that the items are wrinkled during the handling, and at each single introduction into an apparatus they must be smoothed or straightened out before or in connection with the feeding-in to the relevant apparatus.

By the method according to the invention, these inexpedient intermediate smoothing-out operations are avoided, in that the items are in contact with one and the same holding arrangement from start to finish of the handling process.

The washing process takes place in a large vessel, where the items are exposed to a mechanical influence at the same time that the items are present in water to which a detergent has been added. Since this washing method is effected in portions, a great deal of energy is required to drive that part of the washing machine which exercises the mechanical influence on the items, while at the same time a lot of water is used in the process, the reason being that the vessel contains a great deal of water which must be changed regularly, or cleaned if this is possible. Thereafter, the items must be transferred to an ironing section, and this transfer is carried out more or less manually, as mentioned earlier, by the items being hung up in a self-feeder.

The ironing section is built up of a frame in which a number of material-coated ironing rollers rotate. The rollers are arranged transversely to the direction in which the items are fed, and normally there will be between 2 and 6 rollers in such an ironing section. The items are fed from the self-feeder to the first roller in the ironing section, where so-called roller cords, which must ensure that the individual items are fed in under the rollers so that they do not run around with the rollers, extend in the rolling direction from first to last roller. Each roller is provided with a coating of material which is permeable to steam and which transfers heat to the item from a heat source. As counterpart to the individual ironing rollers, there are so-called mulders, which are material-coated steam-heated ironing surfaces, which partly surround the lower part of the individual ironing roller, and which during operation lie up against the items which are to be ironed and press them against the ironing roller. In order to ensure that the items do not wrinkle, it is necessary that the individual rollers have a precise, mutually differentiated speed of rotation, which means that each roller in the sequence rotates slightly more quickly than the preceding roller. Since with this technique it is difficult to control the feeding of the individual items, it frequently occurs that the items are drawn through in a crooked manner or that folds arise in the items.

In addition to the difficulty of creating the differentiated speed of rotation for the rollers, it is also inexpedient that the rollers are held in rotation during the whole of the time that the plant is in operation, in that the amount of energy used for this is not inconsiderable. Moreover, the roller cords which lead the items under/through the rollers must be changed every day, and the relatively costly roller coating must be replaced a couple of times a year.

With the invention, there is provided a method for the washing and/or drying/ironing of a large number of more or less flat items, and a holding arrangement for the transport of the items through such plants which solves the above-mentioned problems. The special aspect of the method according to the invention is that the process or processes take place in a forwardly-progressing movement by means of a holding arrangement with holding means for the securing and stretching-out of the items, said holding arrangement securing and stretching-out the item or items from the feeding-in part of the process, and said holding arrangement feeding the item or the items through the washing and/or ironing part during the whole of the processing or until the processing is finished, where the holding arrangement is moved by means of a transport arrangement which, via carriers, feeds the holding arrangement through the processing plant, and that the items are brought into contact with said fixed and movable parts in the form of transverse elements, at least one of these elements in a processing section being displaceable in a substantially upwards and downwards movement.

With the invention there is also provided a plant for the execution of the method, where the processing part of the plant comprises both fixed as well as movable parts, which parts consist of a number of tubular elements which are disposed in a substantially horizontal manner and transversely to the processing direction, where the movable element or elements, which are preferably placed between fixed elements, are displaceable in a substantially upwards and downwards direction, and a holding arrangement for the feeding of the stretched-out items through the process, said holding arrangement comprising a geometric locking device which secures an item so that the holding arrangement constitutes a provisionally fixed front edge which wholly or partly extends along the front of the item seen in the direction in which the items are transported.

The washing part can in turn be divided up into smaller sections, each with its washing vessel, so that it is possible to change the water in a single or several vessels as required, possibly so that the water from the most dirtied vessels is discarded or filtered. The filtered water can be used in a vessel where the water is more dirty, inasmuch as it is ensured that the rinsing water at the outlet of the washing process is cleaner than the water in the remaining vessels, and that the cleanliness is decreasing in the direction towards the inlet to the washing part. The filtration can be effected either continuously or in portions. With a more simple embodiment, it can be sufficient to change the water in the individual vessels as required.

A washing section contains a number of fixed, substantially horizontal pipes, and a number of movable, substantially horizontal pipes. The fixed pipes are wholly or partly covered by water, and the movable pipe or pipes can be moved in an upwards and downwards direction in such a manner that a holding arrangement is allowed passage by the moving upwards of precisely that movable pipe which exists immediately in front of the momentary position of the holding arrangement, and as soon as the holding arrangement has passed under the lowest placed point of the pipe, the pipe is lowered to its lowermost position, whereby a mechanical influence is achieved due to the friction between pipe and item on both the upper and the lower side of the item. The individual pipes can have identical, different or individual configurations, for example circular or ellipsoidal configurations. In order to achieve increased washing effect, the pipes can have an angular cross-section of some form or another, and/or the number of pipes in the relevant section can be increased, or the number of sections can be further increased.

An ironing section contains a number of substantially horizontal stationary pipes, and a number of substantially horizontal movable pipes. All of the pipes which are placed in this section are heated by means of a heating medium, which can be an electrical heating element, or heated by means of a chemical reaction or combustion or, in a preferred embodiment, by means of a through-flowing heating medium, preferably steam. The movable tube or tubes can be moved in an upwards and downwards direction in such a manner that a holding arrangement is allowed passage by the moving upwards of precisely that movable pipe which exists immediately in front of the momentary position of the holding arrangement, and as soon as the holding arrangement has passed under the lowest placed point of the pipe, the pipe is lowered to its lowermost position, whereby due to the friction between the heated pipe and the item a smoothing-out and drying ironing effect is achieved on both the top side and the under side of the item. The individual pipes can have identical, different or individual configurations, said configurations preferably being circular or ellipsoidal.

The actual feeding-in or insertion of the items takes place by placing a dry item, preferably a piece of textile which on one or more edges is provided with a seam or other form of beaded edge, in a holding arrangement which is arranged to accommodate the beaded edge and secure this during the whole of the handling process. Upon conclusion of the processing of the individual item, the item is released, after which it is folded or in another manner prepared for storage for later use. The holding arrangement can with advantage be provided with channels for the through-flow of water and/or steam, in such a manner that the beaded edge can be influenced by washing and/or drying means.

In the construction of the plant according to the invention, a cheaper and less space-demanding plant is achieved than the traditional plants which are currently known. An additional advantage of a plant and method of this kind is that inexpedient manual handling of relatively heavy items is avoided, in that an item does not have to be touched by hand after having been fed in to the plant according to the present invention. Moreover, apparatuses for the stretching-out of items between the individual processing sections in existing plants are eliminated.

THE DRAWING

Figure 2:
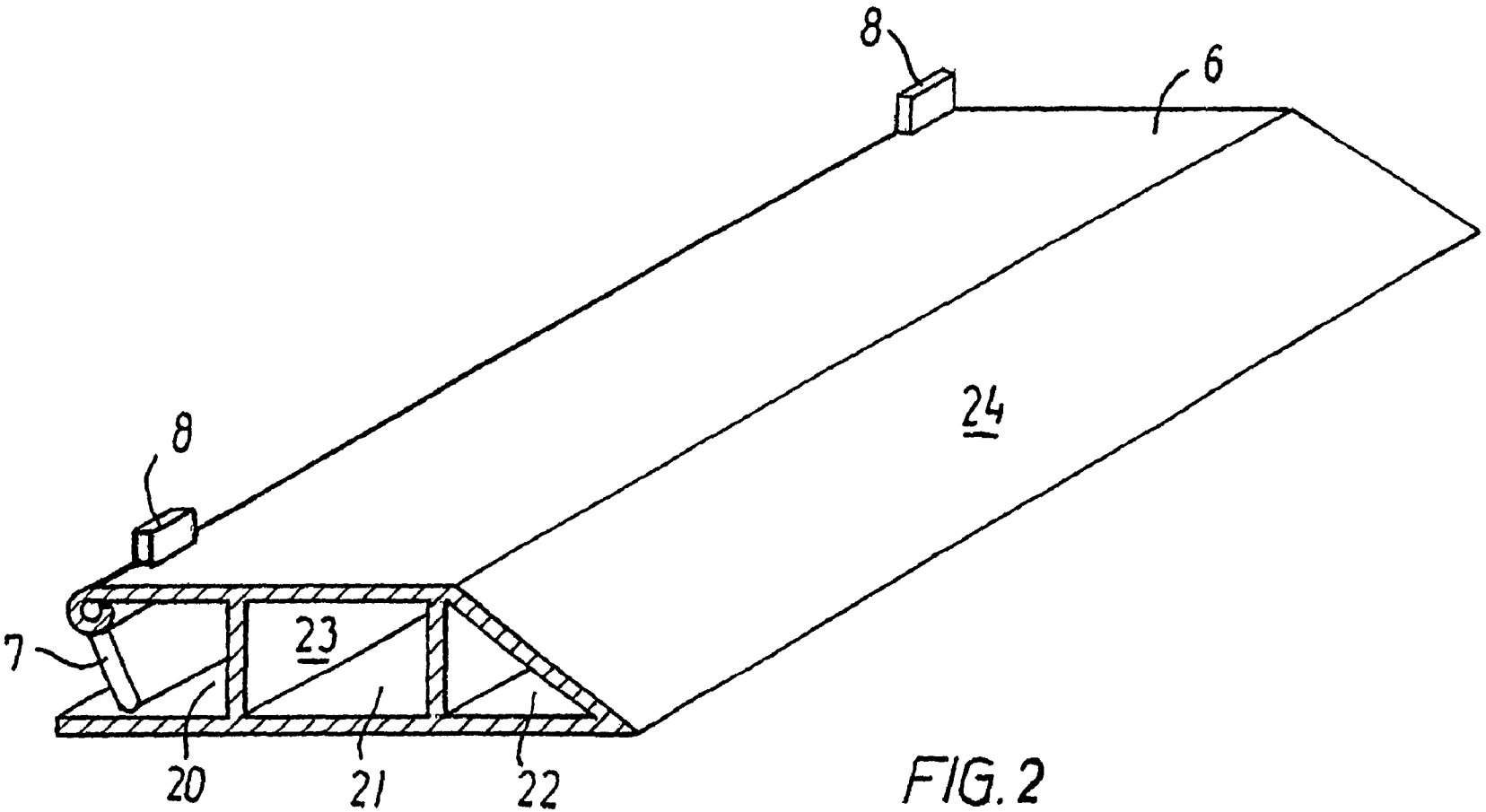
Figure 3:
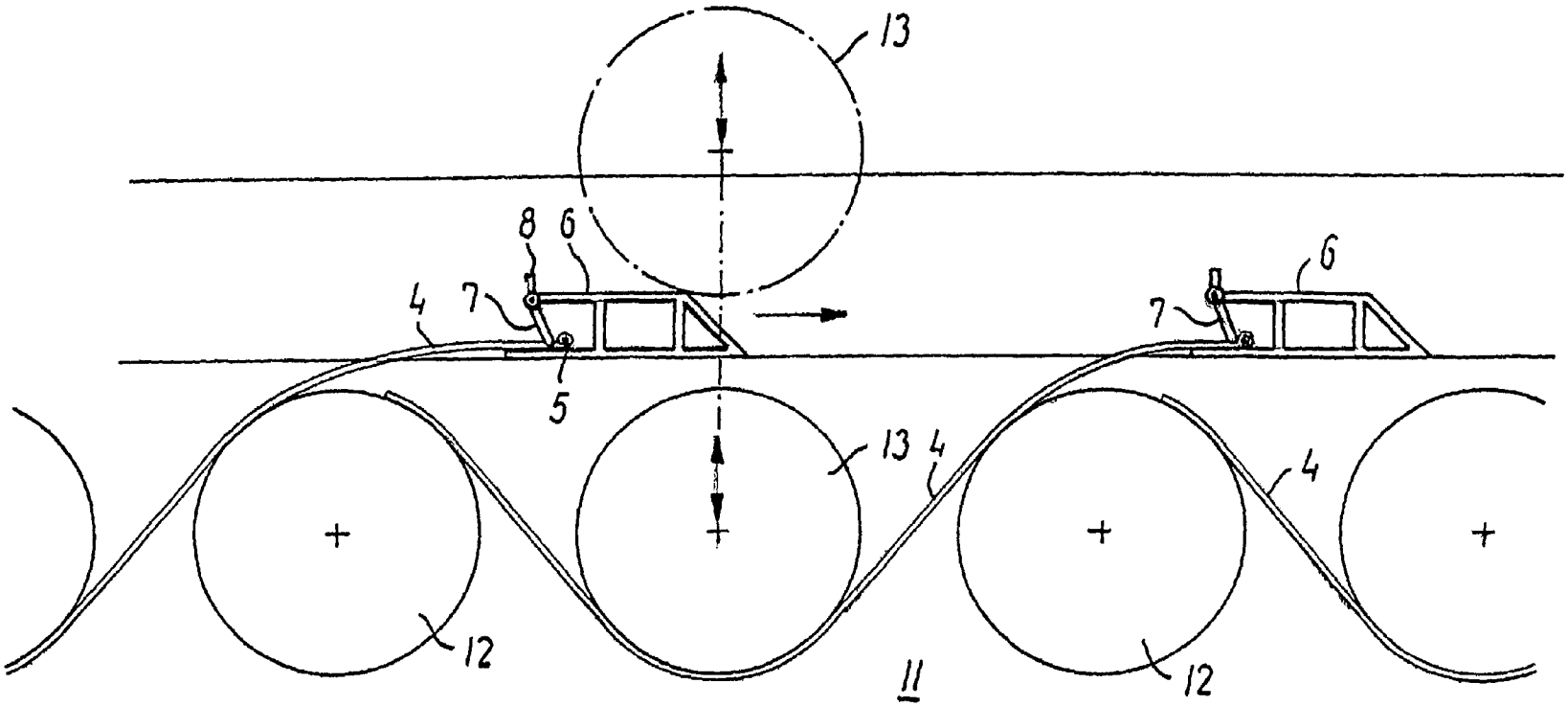
Figure 4:
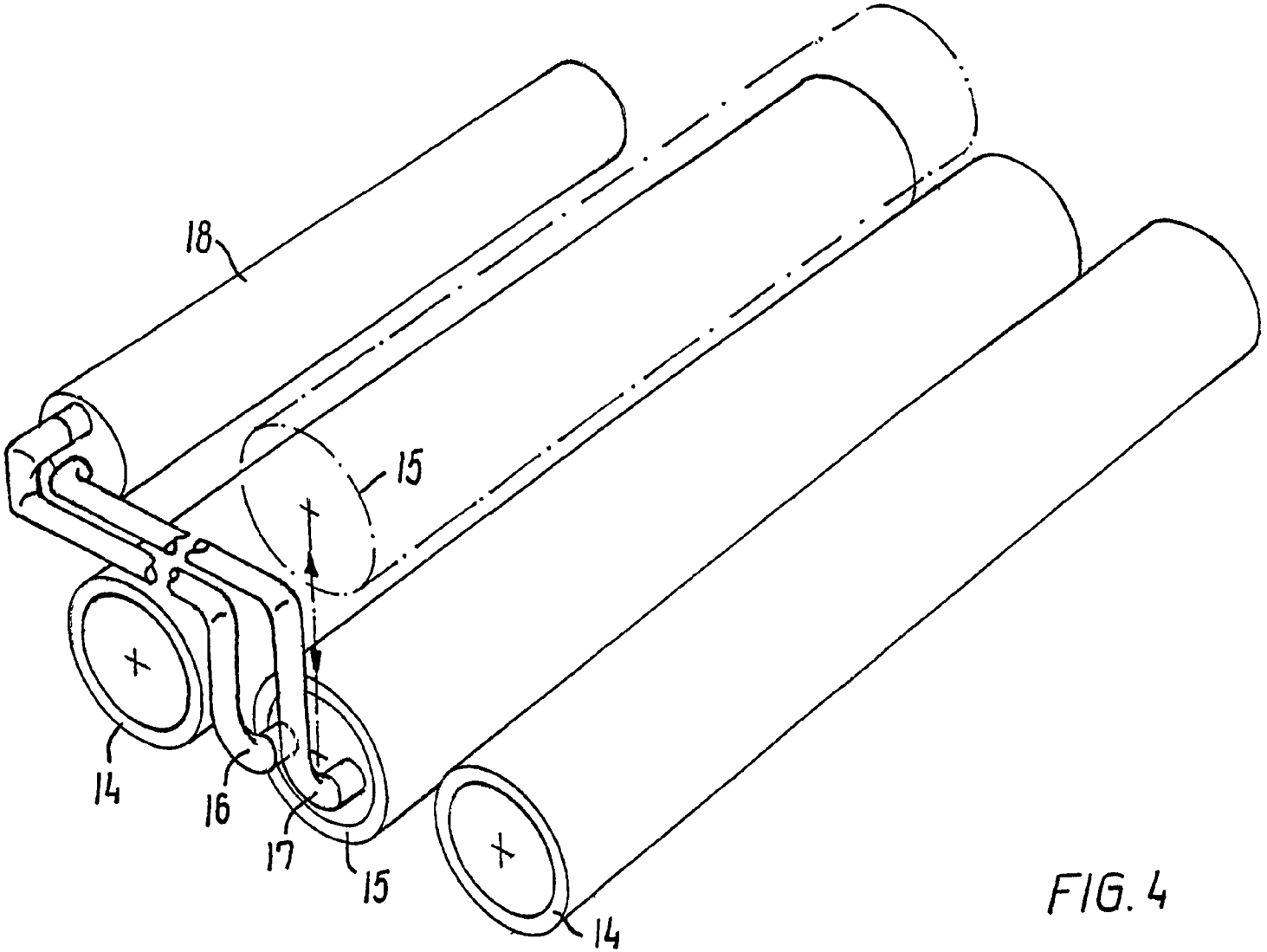
Figure 5:
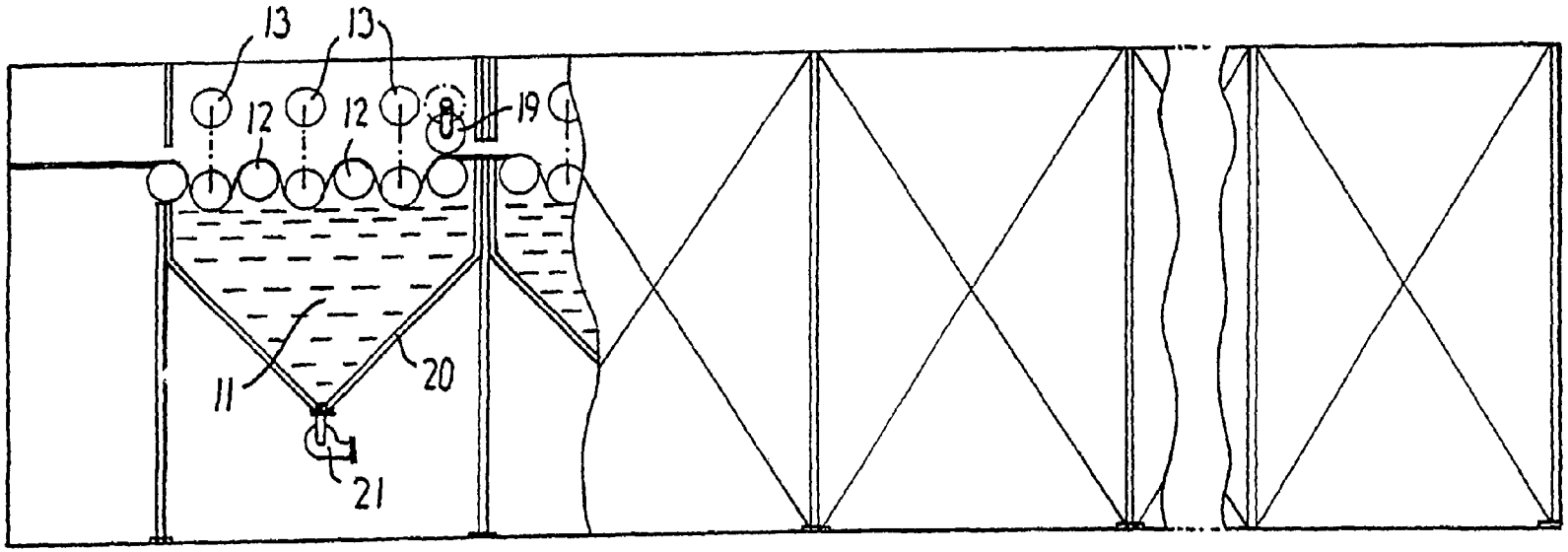
Figure 6:
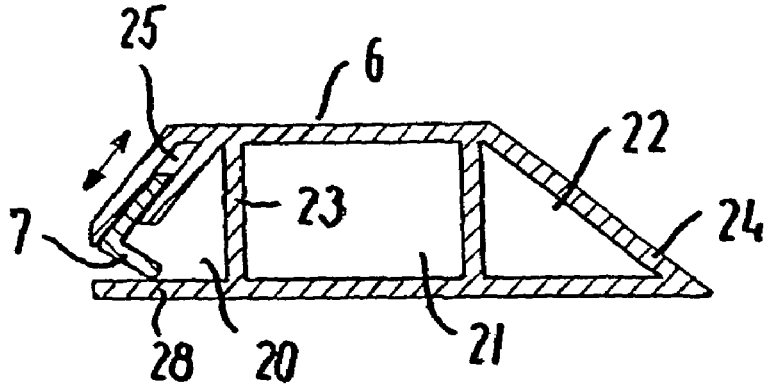
Figure 7:
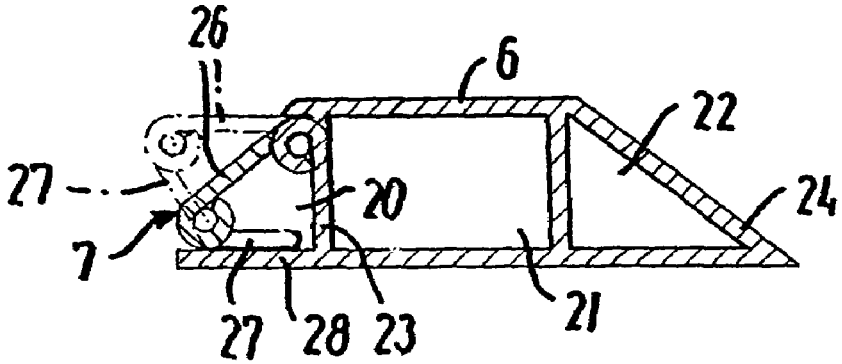
Figure 8:
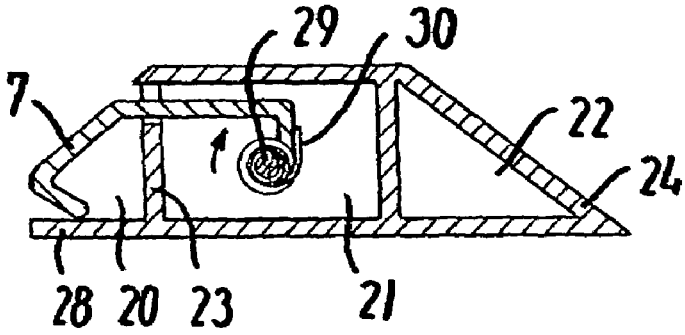

The invention and particularly advantageous embodiments are explained in detail in the following with reference to the figures in the drawing, where FIG. 1 shows a perspective illustration of a feeding-in part for a washing and/or ironing plant according to the invention, FIG. 1*a* shows in principle the insertion of an item into a holding arrangement, FIG. 2 shows a preferred embodiment of a holding arrangement for securing and transport of substantially flat items, FIG. 3 shows schematically the path followed by an item through a washing section, FIG. 4 shows the construction of an ironing section in principle, FIG. 5 shows a processing plant with several processing sections in a preferred embodiment, FIG. 6 shows a second embodiment of a holding arrangement for securing and transport of substantially flat items, FIG. 7 shows a further embodiment of a holding arrangement for securing and transport of substantially flat items, and FIG. 8 shows yet a further embodiment of a holding arrangement for securing and transport of substantially flat items.

THE EXAMPLE EMBODIMENT

In FIG. 1 is seen a feeding-in part for a washing and/or ironing plant according to the method, where a feeding-in part 1, which preferably consists of a more or less plane surface on which there are mounted a spindle motor, pneumatic or hydraulic cylinders or another form of arrangement for linear displacement 2, where said arrangement, together with an elongated plate-shaped part 3 which extends for the same length or longer than the breadth of an item 4, serves as feeder 2,3. The function of the feeder 2,3 is to lay the one end of an item 4, the end of which is provided with a seam, a beaded or other form of edge 5, in the holding arrangement 6. In a preferred embodiment, the holding arrangement 6, a so-called stick, is configured as a profile part which to the rear is provided with a form of geometric lock 7, preferably a flap which holds the front edge 5 of the item 4 during the whole of the processing of the item 4, upon conclusion of which the item 4 is released from the holding arrangement 6 via a release mechanism 8 which works in connection with the lock 7. The release mechanism can be of electromagnetic, pneumatic/hydraulic or mechanical configuration, but in the preferred embodiment it is configured as one or more spring-influenced release pins or grips.

A preferred embodiment of a holding arrangement 6 is shown in FIG. 2, where the holding arrangement 6 comprises a number of channels 20, 21, 22 which extend transversely to the feeding direction, with a first channel 20, the one channel wall or side of which constitutes the geometric lock 7 for securing the item 4. This channel 20 is configured for through-flow of the active washing fluid in the washing section, so that the secured edge 5 of the item 4 also goes through a washing process. A second channel 21 is arranged for the through-flow of steam, hot air or the like, in such a manner that an intermediate wall part 23, which forms a partition between a first channel 20 and a second channel 21, is provided with not-shown holes or jets, so that steam, hot air or the like can be led into the first channel 20 from the second channel 21 for drying of the edge 5 of the item 4. A channel 22 can be configured at the front with an inwardly-sloping wall part 24, so that the holding arrangement 6 comes to appear with an inclined, downwards-sloping front edge.

Before the feeding of the items 4 into the plant, a form of magazine can be provided for the storage of holding arrangements 6 which, one after the other, are ready to receive the front edge 5 of the item 4 in the lock 7 of the holding arrangement 6.

A holding arrangement 6 of the present construction can be used in many different plants for the transport of substantially flat items of a relatively flexible character, and for this reason the use of this holding arrangement 6 is not limited to use in connection with washing and/or ironing plants.

Either manually or by means of a not further disclosed feeding arrangement, an item 4 is placed with its leading edge 5 between the feeder 2,3 and the holding arrangement 6. When by means of the feeder 2,3, the leading edge 5 of the item 4 is locked firmly in the holding arrangement 6, the item is provided with a provisionally firm front edge which is able to transport the item 4 through parts of or through the whole of the washing/ironing process. The holding arrangement 6 is fed in by the feeding-in part 1 on a transport arrangement 9, which with advantage can be configured as a pair of parallel conveyor belts 9 with a number of carriers 10 or pins which are disposed at suitable intervals, so that the holding arrangements 6 are supported and fed forwards with a suitable distance between them, depending on the length of the individual items 4 in the transport direction. The distance between the conveyor belts 9 is greater than the breadth of the broadest item, and less than the extent of the holding arrangements 6 transversely to the direction of transport. The holding arrangement 6 is fed by the carriers 10 on the conveyor belt 9 into one of the processing sections, where the first processing section will normally be a washing section. The holding arrangement 6 can feed the item 4 from process to process, and feed the item 4 through each individual process with possible waiting positions between the individual processes. It is also possible for parts of the process to be skipped, merely by use of commonly-known internal transport, where the holding arrangement 6 with item 4 is fed to the relevant, desired position.

A path through the processing plant can be washing-ironing, washing-drying, washing-drying-ironing, or other combinations of processes, possibly followed by a folding of the item 4, but can also be effected as parts of the above-mentioned processes.

A washing section according to FIG. 5 comprises a vessel 11 containing a liquid, preferably water to which some form of detergent or cleansing agent has been added. As shown in FIG. 3, in the vessel 11 and transversely to the transport direction there is disposed a number of pipes 12, preferably at least two pipes, which can be fixed or can be rotated around their longitudinal axes, said pipes preferably being of circular cross-section, but can also be of other configurations, for example with ellipsoidal or polygonal cross-sections. In the space between these pipes 12 there are placed movable pipes 13 which can be moved in an upwards and downwards direction, so that these movable pipes 13 are in their uppermost position until the holding arrangement 6 has just passed under the relevant pipe 13, after which the pipe is moved downwards to a position on a level with the fixed pipes 12. In this manner, the item passes over the pipes 12 and under the pipes 13, so that both the upper and under sides of the item are influenced by the friction of the pipe surfaces. If it is desired to increase the washing effect, one or more of the fixed pipes 12 can be driven around by a drive arrangement provided for this purpose, and the cross-section of the tube or tubes 14 can, for example, be rectangular or of other polygonal cross-section. In cases where the item 4 is very long, or in other cases where there is need for the item 4 to traverse a longer path, the movable pipes can be disposed in a position which lies lower than that height at which the fixed pipes 12 are lying. In this manner, it is achieved that the holding arrangement 6 which feeds the next item 4 through the process can be placed on the conveyor belt 9 with a smaller distance than otherwise up to the preceding holding arrangement 6, inasmuch as two items 4 must not overlap one another during the transport. Each washing section concludes with one or more sets of rollers 19 which, by rotating in opposite directions, are able to press most of the water out of the item, whereby it is possible to have water of different degrees of cleanliness in the individual vessels 11, where the cleanliness increases in the direction of transport. A further advantage of having this division of sections is that the water can be precisely dosed with the necessary additives, such as detergents, softeners or the like. Moreover, it can be sufficient to change the water in one vessel 11 at a time, whereby the consumption of water is considerably reduced.

The ironing section shown in FIG. 4 is built up in more or less the same way. Transversely to the transport direction there are disposed a number of pipes 14, preferably at least two pipes which are preferably fixed, said pipes 14 preferably being of circular cross-section, but which can also be of other configurations, for example of ellipsoidal cross-section. In the space between these pipes 14 there are placed movable pipes 15 which can be moved in an upwards and downwards direction, so that these movable pipes 15 are in their uppermost position until the holding arrangement 6 has just passed under the relevant pipe 15, after which the pipe is moved downwards to a position on a level with the fixed pipe 14. In this manner, the item passes over the pipes 14 and under the pipes 15, so that both the upper and under sides of the item are influenced by the friction of the pipe surfaces. If it is desired to increase the ironing effect in cases where the item 4 is very long, or in other cases where there is need for the item 4 to traverse a longer path, the movable pipes 15 can be disposed in a position which lies lower than that height at which the fixed pipes 14 are lying. In this manner, it is achieved that the holding arrangement 6 which feeds the next item 4 through the process can be placed on the conveyor belt 9 with a smaller distance than otherwise up to the preceding holding arrangement, inasmuch as two items 4 must not overlap one another during the transport.

In order to achieve a satisfactory ironing effect, one or more of the pipes 14, 15 are heated, preferably all of the pipes 14, 15 in an ironing section, by means of a heat-transferring medium, which medium is preferably steam. The heated pipes 14, 15 are provided with an inlet 16 for steam, and an outlet 17 for condensate. On the movable pipes 15 there is configured a form of stub 18 to which commonly-known flexible tubular connections can be secured.

If a certain type of item 4 has need for an intermediate drying, or a final drying instead of ironing, the holding arrangement 6 with the item 4 can be transported to a drying plant where one or more items at a time can be dried with hot air or other form of drying process.

When the individual item 4 has gone through the process determined for the item, the item 4 is fed to a folding machine or other form of end process, after which the items 4 are ready for collection and further use.

An expedient embodiment of the holding arrangement 6 can thus be that the holding arrangement 6 has a surface 24 which slopes downwards to form a point at its forwardly-facing edge. This configuration, or other similar configuration, can be of advantage in cases where the holding arrangement 6 with its front edge in contact with the movable roller 13, 15 initiates a short upwards movement of the roller 13, 15, inasmuch as the holding arrangement 6 having just passed under the roller 13, 15 again allows the roller 13, 15 to be brought into its working position, which is a lower position.

On the holding arrangement 6 there are provided one or more triggers 8 which influence a lock 7 when the edge 5 of the item 4 shall be released upon conclusion of the processing. The trigger 8 can be in the form of a pin, a stud or the like. The important aspect of this trigger 8 is that it is placed in such a manner that it is not influenced unintentionally, in that the item 4 would otherwise fall out of engagement in the holding arrangement 6 at some point in the processing plant. Therefore, the trigger 8 is preferably placed at an outer end of the holding arrangement 6, so that the rollers 12, 13, 14, 15 do not come into contact with the trigger 8.

It can also be arranged that the trigger does not sit in connection with the lock 7, but that a not-shown external pin or arm moves in and releases the item 4 by a pressure on the lock 7 itself.

In FIG. 4 there is shown an example of the pipe connections to and from a movable ironing roller 15. The fixed roller 14 is provided with a heating medium in an ordinary manner (not-shown).

Other embodiments of the holding arrangement are seen in FIGS. 6–8 and are described briefly in the following. In order to bring the movable ironing roller 15 into contact with the item 4 which is to be ironed in as short a distance as possible after the holding arrangement 6, it can be preferred to configure the holding arrangement 6 with a downwards-sloping rear edge. Together with a differently configured geometric lock 7, this will result in a larger part of the item 4 being influenced by the ironing roller 15. The lock 7 can be configured with a hinge part placed in the immediate proximity of the upper plane part of the holding arrangement 6. From here, the lock 7 slopes rearwards and downwards.

The lock part 7 can have different configurations. For example, the lock 7 can be configured as a profile which can slide in a slot 25 formed in the holding arrangement 6 (FIG. 6). Here, the lowermost edge of the lock 7 forms an angle with the remaining part of the lock 7, whereby the lowermost edge extends forwards in the transport direction for the holding arrangement 6. The lock 7 hereby brings about a geometric securing of an item 4 in the holding arrangement 6, in that the slot extends downwards/rearwards in the transport direction for the holding arrangement 6. Moreover, an additional securing effect for the item 4 can be achieved by placing a spring or the like in the slot 25 in the holding arrangement 6.

A second way in which the lock part 7 can be configured can be to let the lock part 7 comprise two hinge parts, and to secure the lock part 7 to the holding arrangement 6 with a first hinge part 26, said first hinge part 26 being secured in a pivotal manner to the rearmost part of the upper part of the holding arrangement 6, from where the hinge part extends rearwards and downwards seen in the direction of movement of the holding arrangement 6, to a second hinge part 27 which lies up against the rearmost part of the lower part 28 of the holding arrangement 6. This second hinge part 27 extends as a form of flap which constitutes the furthermost part of the lock part 7. In order to secure an item in the holding arrangement 6, these first and second hinge parts 26, 27 can each be of such a length that they are larger than the distance between the upper side and the under side of the holding arrangement. At the same time it is ensured that the first hinge part can not swing to a position over the upper edge of the holding arrangement 6, for example by providing a limitation in the hinge itself or by letting the upper edge of the holding arrangement 6 continue rearwards in one or more places seen over the extent of the holding arrangement 6, in order to form a stop for the first hinge part 26 in an upper position. In connection with the contact of the second hinge part 27 against the rearmost part of the lower part 28 of the holding arrangement 6, it is a precondition that this part of the holding arrangement 6 extends so far rearwards seen in the transport direction that it is possible for the second hinge part 27 to form contact against the holding arrangement 6. The lower part 28 of the holding arrangement can extend shorter or longer rearwards in the transport direction of the holding arrangement 6, in that its primary function is to secure the item 4 together with the lock part 7.

The lock part 7 can also be configured as a profile in one piece, which at its one end is pivotally connected to an axis of rotation 29 in the holding arrangement 6, said axis of rotation 29 preferably being placed in the centre area of the holding arrangement 6, so that by means of resistance the lock part 7 secures an item 4 at the front edge 5 of the item. The resistance can, for example, be effected by a spring element 30 or the like, where said spring element 30 can be a torsion spring or other form of spring. The function of the spring element 30 is to exert a pressure on the lock part 7, so that the lock part 7 is held against the item 4 and herewith against the lower part 28 of the holding arrangement 6.

It is common to all of these embodiments of the lock part 7 that they can all be released by means of a trigger mechanism 8, which can be influenced by a release element from the plant as described earlier.

The plant according to the invention is not limited to a configuration with a single lane for transport of the items through the plant. For example, the plant can be built up so that it is possible to feed items on several conveyors which run independently, and which do not need to be filled with items in a synchronous manner.

An example of a construction can be to arrange a number of transport lanes at the side of one another. An overlap can be possible between the individual transport lanes, in such a manner that two or more holding arrangements which are fed in lanes lying side by side utilise a common conveyor belt. This requires that the conveyor belts which are not lying on an outer side are broad enough to be able to receive and transport two holding arrangements placed side by side, and that all conveyor belts are driven at approximately the same speed of transport.

Another example of how a plant can be built up with a number of transport lanes side by side can be a construction with a number of transport lanes each with their own set or pair of conveyor belts. Furthermore, this provides the possibility of feeding items in several lanes, where each individual lane can be fed at a speed which does not need to correspond to a speed determined by one of the remaining lanes.

An equal distribution in equally broad lanes can be envisaged, but also solutions where the lanes have different breadths can be preferred. Such lanes can be configured with different breadths between the conveyor belts, which thus requires holding arrangements with an extent transversely to the transport direction which corresponds to that breadth of transport which is suitable for the individual transport lanes.

What is claimed is:

1. A method for processing substantially flat textile items comprising:

providing a processing plant having processing sections for at least washing and/or ironing said substantially flat textile items, said processing plant containing both fixed and movable parts in the form of transverse elements (12, 13, 14, 15), at least one of said movable elements being movable in a substantially upwards and downwards movement and being located in a washing and/or ironing processing section, engaging the substantially flat textile items at a feed into the processing plant of the substantially flat textile items using a holding arrangement for securing and stretching-out the items (4), said holding arrangement (6) having a geometric lock arrangement (7) for securing an item (4), so that the holding arrangement (6) forms a temporary fixed front edge extending wholly or partly along a front side (5) of the item (4) relative to a transport direction, the holding arrangement (6) having a number of channels (20,21,22) which extend transversely to the transport direction, one or more channels (20,21) supplying an active washing liquid and/or a drying medium to the fixed front edge (5) of the item (4), engaging the holding arrangement (6) using a transport arrangement (9) having carriers (10), for moving the held substantially flat textile items through the processing plant, individually and automatically feeding the held substantially flat textile items to the processing plant, transporting successively and continuously said held substantially flat textile items through said processing plant in a forwardly progressing transport direction, and, contacting the held substantially flat textile items with said fixed and movable parts located in the washing and/or ironing processing section as the held substantially flat textile items are transported therethrough.

2. The method according to claim 1, further comprising providing air or steam to the fixed front edge (5) of the item (4) through openings in the holding arrangement.

3. The method according to claim 1 wherein the lock arrangement has a locking part (7), and further comprising moving the locking part between a locking position and an open position, the locking part moving within an elongated slot (25).

4. The method according to claim 3, wherein the locking arrangement (7) has a first hinge part (26), from which the locking part (7) extends downward and rearwards, relative to a direction of movement of the holding arrangement (6) towards a second hinge part (27), from which a flap part lies up against a rearmost part of a lowermost part of the holding arrangement (6), for scuring the item (4) at the front edge (5).

5. The method according to claim 3, or 4 wherein the locking part (7) is pivotally secured at one end to an axis of rotation (29) in the holding arrangement (6), and further comprising providing a spring element for biasing the locking part so that the influence from the spring element (30) on the locking part (7) secures the item (4) at the front edge (5).

6. The method according to claim 1 further comprising completely or partially filling an area around the transverse elements (12, 13) with liquid, transporting the items (4) through the area and exposing the items to a friction from surfaces of the transverse elements (12, 13).

7. The method according to claim 1 further comprising flowing a heating medium through at least one of the transverse elements (14, 15).

8. The method according to claim 1 further comprising flowing steam through at least one of the transverse elements (14, 15).

9. A processing plant for washing and/or ironing substantially flat textile items which are fed automatically and individually by a feeding apparatus to the processing plant and transported successively and continuously through the processing plant, said processing plant comprising both fixed and movable processing parts, said processing parts consisting of a number of tubular elements (12, 13, 14, 15) disposed in a substantially horizontal manner and transversely to a processing direction, the movable elements (13, 15) being placed between fixed elements (12, 14) and being displaceable in a substantially upwards and downwards direction, and a holding arrangement (6) for holding and transporting stretched-out items (4) through the processing plant, said holding arrangement (6) having a geometric lock arrangement (7) for securing an item (4), so that the holding arrangement (6) forms a temporary fixed front edge extending wholly or partly along a front side (5) of the item (4) relative to a transport direction, the holding arrangement (6) having a number of channels (20, 21, 22) which extend transversely to the transport direction, one or more channels (20,21) supplying an active washing liquid and/or a drying medium to the fixed front edge (5) of the item (4).

10. The processing plant according to claim 9, wherein air or steam are supplied to the fixed front edge (5) of the item (4) through openings in the holding arrangement.

11. The processing plant according to claim 9 or 10 wherein the lock arrangement has a locking part (7) which moves between a locking position and an open position, the locking part moving within an elongated slot (25).

12. The processing plant according to claim 11, wherein the locking arrangement (7) has a first hinge part (26), from which the locking part (7) extends downward and rearwards, relative to a direction of movement of the holding arrangement (6) towards a second hinge part (27), from which a flap part lies up against a rearmost part of a lowermost part of the holding arrangement (6), for securing the item (4) at the front edge (5).

13. The processing plant according to claim 11, wherein the locking part (7) is pivotally secured at one end to an axis of rotation (29) in the holding arrangement (6), a spring element provided for biasing the locking part so that the influence from the spring element (30) on the locking part (7) secures the item (4) at the front edge (5).

14. The processing plant according to claim 9 wherein a heating medium flows through at least one of the tubular elements (14, 15).

15. The processing plant according to claim 9 wherein steam flows through at least one of the tubular elements (14, 15).

16. The processing plant according to claim 9 wherein one or more of the tubular elements (12, 13, 14, 15) are rotated around an axis which lies transversely in relation to the transport direction such that a relative speed between the item (4) and one or more of the tubular elements (12, 13, 14, 15) is changing.

17. A processing plant for washing and/or ironing substantially flat textile items which are fed automatically and individually by a feeding apparatus to the processing plant and transported successively and continuously through the processing plant, said processing plant comprising both fixed and movable processing parts, said processing parts consisting of a number of tubular elements (12, 13, 14, 15) disposed in a substantially horizontal manner and transversely to a processing direction, the movable elements (13, 15) being placed between fixed elements (12, 14) and being displaceable in a substantially upwards and downwards direction, and a holding arrangement (6) for holding and transporting stretched-out items (4) through the processing plant, said holding arrangement (6) having a geometric lock arrangement (7) for securing an item (4), so that the holding arrangement (6) forms a temporary fixed front edge extending wholly or partly along a front side (5) of the item (4) relative to a transport direction, the holding arrangement (6) having a number of channels (20,21,22) which extend transversely to the transport direction, an area around the tubular elements (12, 13) being completely or partly filled with liquid, the items (4) transported through the area being exposed to a friction from surfaces of the tubular elements (12, 13).

18. The processing plant according to claim 17 wherein a heating medium flows through at least one of the tubular elements (14, 15).

19. The processing plant according to claim 17 wherein steam flows through at least one of the tubular elements (14, 15).

20. The processing plant according to claim 17 wherein one or more of the tubular elements (12, 13, 14, 15) are rotated around an axis which lies transversely in relation to the transport direction such that a relative speed between the item (4) and one or more of the tubular elements (12, 13, 14, 15) is changing.

* * * * *

UNITED STATES PATENT AND TRADEMARK OFFICE

CERTIFICATE OF CORRECTION

PATENT NO. : 6,996,881 B2
APPLICATION NO. : 10/380012
DATED : February 14, 2006
INVENTOR(S) : Bent Ivan Kjellberg It is certified that error appears in the above-identified patent and that said Letters Patent is hereby corrected as shown below:

On the Title Page, insert: Item (30)
Foreign Application Priority Data
PA 2000 01352 FILED IN DENMARK ON SEPTEMBER 12, 2000;

Signed and Sealed this

Twelfth Day of September, 2006

JON W. DUDAS
*Director of the United States Patent and Trademark Office*